US007163372B2

(12) United States Patent
Kegg

(10) Patent No.: US 7,163,372 B2
(45) Date of Patent: Jan. 16, 2007

(54) DIFFUSER FOR A MOTOR FAN ASSEMBLY

(75) Inventor: Steven W. Kegg, Uniontown, OH (US)

(73) Assignee: The Hoover Company, North Canton, OH (US)

( * ) Notice: Subject to any disclaimer, the term of this patent is extended or adjusted under 35 U.S.C. 154(b) by 428 days.

(21) Appl. No.: 10/733,085

(22) Filed: Dec. 10, 2003

(65) Prior Publication Data

US 2005/0129512 A1 Jun. 16, 2005

(51) Int. Cl.
*F04D 29/44* (2006.01)
*F04D 17/00* (2006.01)

(52) U.S. Cl. ..... 415/208.2; 415/211.2

(58) Field of Classification Search ..... 415/119, 415/208.2, 211.2
See application file for complete search history.

(56) References Cited

U.S. PATENT DOCUMENTS 5,296,769 A * 3/1994 Havens et al. ..... 310/90
6,309,180 B1 * 10/2001 Gilliland et al. ..... 415/208.2
6,703,754 B1 * 3/2004 Finkenbinder et al. ..... 310/227
6,808,365 B1 * 10/2004 Poon et al. ..... 415/208.2

* cited by examiner

*Primary Examiner*—Edward K. Look
*Assistant Examiner*—Nathan Wiehe
(74) *Attorney, Agent, or Firm*—A. Burgess Lowe, Esq.; Michael J. Corrigan, Esq.

(57) ABSTRACT

A floor care appliance is provided with a motor-fan assembly that includes a diffuser to improve efficiency but also reduces any resultant noise generated. The diffuser is disc shaped and has a plurality of equi-distant spaced vanes around the periphery. The vanes improve performance by converting air velocity into static pressure rise. The vanes also reduce noise by making the flow more uniform. A periphery of radially extending return vanes are arranged circumferentially on one side of the disc. The return vanes remove swirl and improve performance before directing the air through the interior of the motor for cooling.

11 Claims, 7 Drawing Sheets

DIFFUSER FOR A MOTOR FAN ASSEMBLY

BACKGROUND OF THE INVENTION

1. Field of the Invention

This invention relates to floor car, and more specifically, to a diffuser for a motor-fan assembly for a floor care appliance.

2. Summary of the Prior Art

Floor care appliances are well known in the art. Typical floor care appliances include upright vacuum cleaners, canister vacuum cleaners, hard floor cleaners, and extractors. It is known to provide the motor-fan assembly for a floor care appliance with a diffuser for improving system efficiency. However, with the improvement in efficiency comes an increase in noise from the airflow. Therefore, there exists the need for a diffuser that improves efficiency but also reduces the associated generated noise. The present invention provides a diffuser that improves efficiency but also reduces the associated generated noise.

SUMMARY OF THE INVENTION

A diffuser is commonly used to slow the flow and to increase the static pressure of the working air stream after it leaves the outlet of the working air fan or impeller of a motor-fan assembly. The result of this increased static pressure rise (or suction) in a vacuum cleaner fan system is an increase in air-watts for a given amount of input power. While diffusers do a good job of improving system efficiency, they can have a negative effect in that unwanted noise can be generated during the process. This unwanted noise is commonly produced at the fan blade passing frequency. It has been found that a diffuser in which the vanes are oriented in an axial manner and not directly across from the fan blade tips can reduce or eliminate noise generated at the blade passage frequency. The vanes are axially arranged around the periphery of the diffuser to improve performance by converting air velocity into static pressure rise. The vanes also reduce noise by aligning the flow and making it more uniform. The flow is directed to radially arranged return vanes on the under side of the diffuser which further slows the flow and directs it to the interior of the motor for cooling.

BRIEF DESCRIPTION OF THE DRAWINGS

Reference may now be had to the accompanying drawings for a better understanding of the invention, both as to its organization and function, with the illustration being only exemplary and in which.

DETAILED DESCRIPTION OF THE INVENTION

Figure 1:
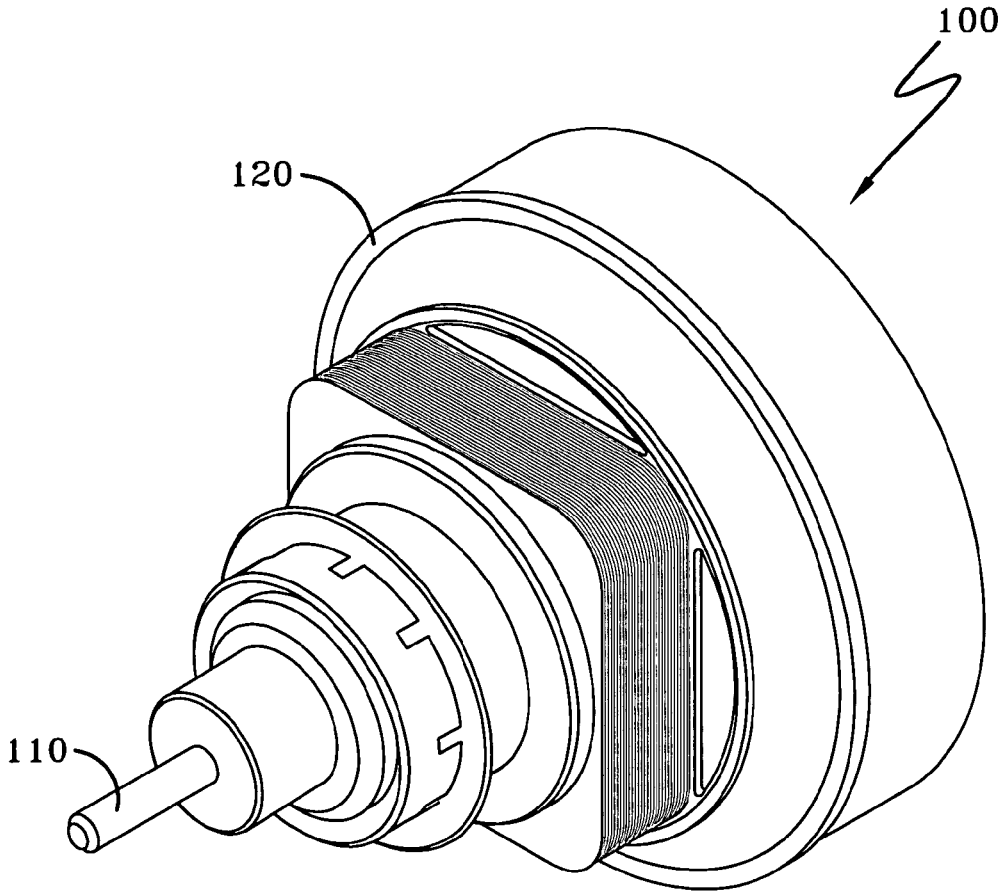
FIG. 1 is a perspective view of a motor-fan assembly for a floor care appliance with a diffuser for improving efficiency and reducing noise, according to the preferred embodiment of the present invention.

Referring now to FIG. 1, shown is a motor-fan assembly 100 for a floor care appliance such as an upright vacuum cleaner (not shown), according to the preferred embodiment of the present invention. Typically, a vacuum cleaner (not shown) includes a foot (not shown) and an upper housing assembly (not shown) pivotally connected to the foot (not shown). The foot (not shown) is similar to those known in the art and includes a nozzle opening (not shown) for receiving a stream of dirt-laden air and an agitator (not shown) for agitating and loosening dust and debris from a floor surface. The motor-fan assembly 100 creates the suction necessary to remove the loosened dust and debris from the floor surface. The motor-fan assembly 100 fluidly connects to the foot or suction nozzle (not shown) by a dirt duct (not shown). The upper housing assembly (not shown) houses a particle filtration and collecting system (not shown) for receiving and filtering the dirt-laden air stream which is created by the motor-fan assembly 100. The motor-fan assembly 100 shown is used in what is typically known as an "indirect air" system.

Figure 2:
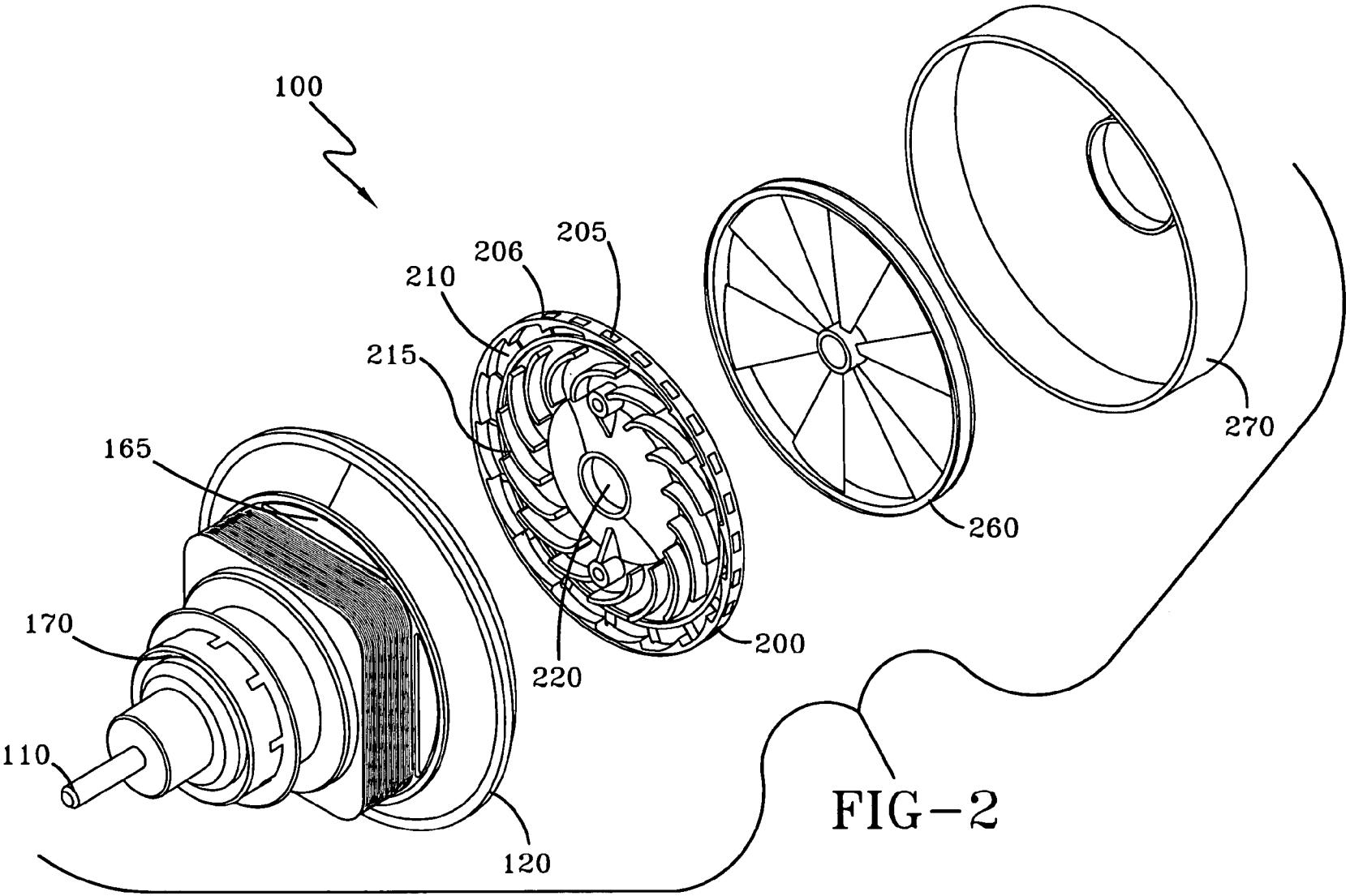
FIG. 2 is an exploded perspective view of the motor-fan assembly of FIG. 1; according to the preferred embodiment of the present invention.
Figure 3:
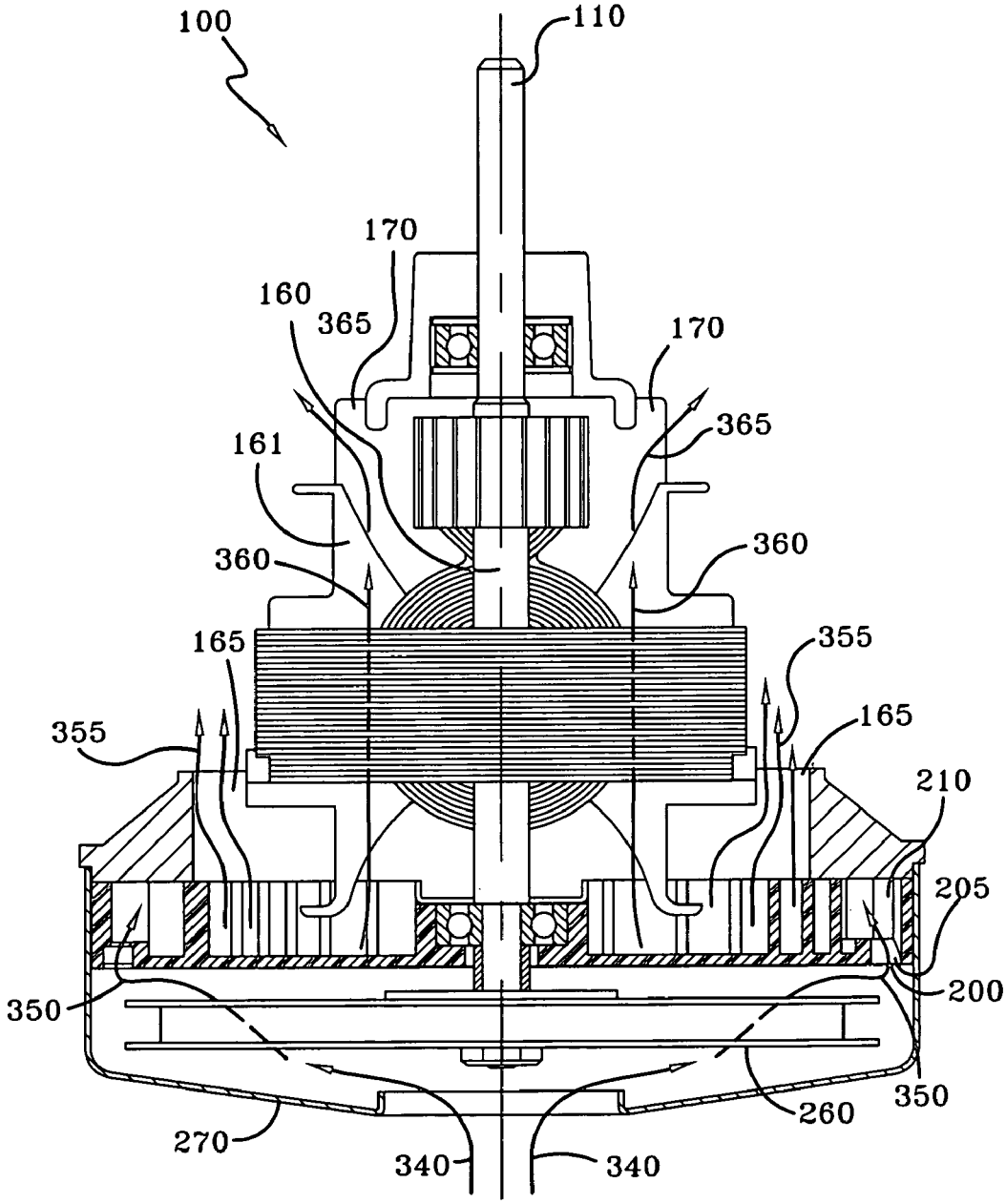
FIG. 3 is a sectional view of the motor-fan assembly shown in FIG. 2, according to the preferred embodiment of the present invention.
Figure 4:
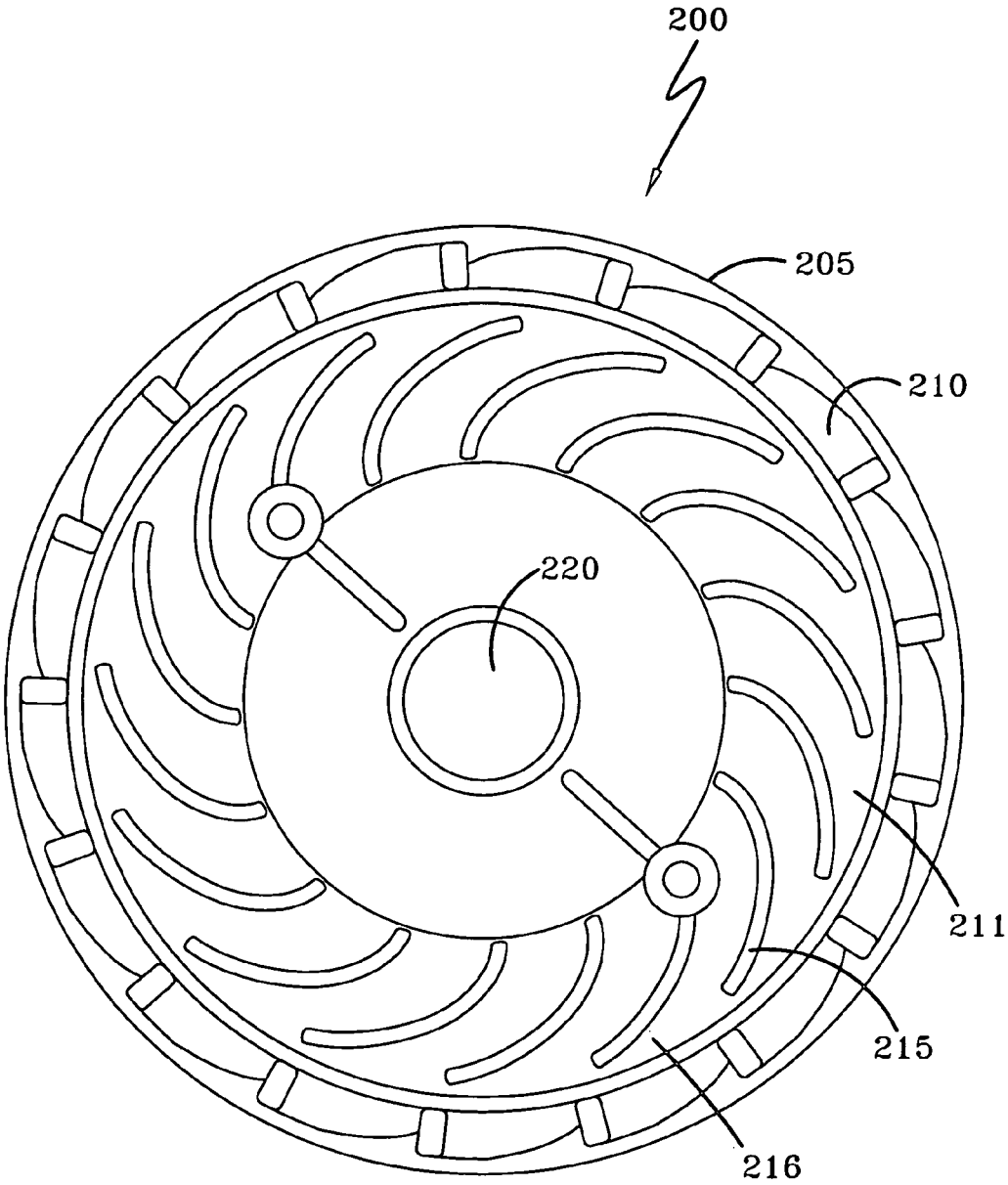
FIG. 4 is a bottom view of the diffuser for the motor-fan assembly of FIG. 1; according to the preferred embodiment of the present invention.

Referring now to FIGS. 2 through 4, shown is a motor-fan assembly 100 with a diffuser 200, according to the preferred embodiment of the present invention. Coincident with the motor shaft 110 is the diffuser 200, an impeller 260 and a housing cover 270. Air is drawn (arrows 340) into the suction inlet 271 located at the center of housing 270 by the impeller 200 and passes through the impeller 200 (arrows 350) being directed toward diffuser 200 as shown by arrows 350. Air is drawn into diffuser 200 through apertures 205 ringing the periphery 206 of diffuser 200. The air then enters a plurality of channels or vanes 210 also ringing the periphery 206 of diffuser 200 but located on the lower side 216 of diffuser 200. The channels or vanes 210 improve performance by converting air velocity into static pressure rise. While diffusers such as diffuser 200 do a good job of improving system efficiency, they can have a negative effect in that unwanted noise can be generated during the process. This unwanted noise is commonly produced at the fan blade passing frequency of the working air fan. It has been found that a diffuser in which the vanes are oriented in an axial manner and not directly across from the fan blade tips can reduce or eliminate noise generated at the blade passage frequency. The vanes or channels 210 also reduce noise by aligning the flow and making it more uniform. The flow is directed to radially arranged return vanes 215 on the under side of the diffuser 200 which further slows the flow and directs some of the air through (arrows 360) to the interior 161 and internal components 160 of the motor-fan assembly 100 for cooling. Some of the air (arrows 355) is exhausted to the atmosphere through a port 165 formed in a collar 120. The air directed to the interior 161 is then further directed (arrows 365) to the atmosphere through ports 170.

Figure 5:
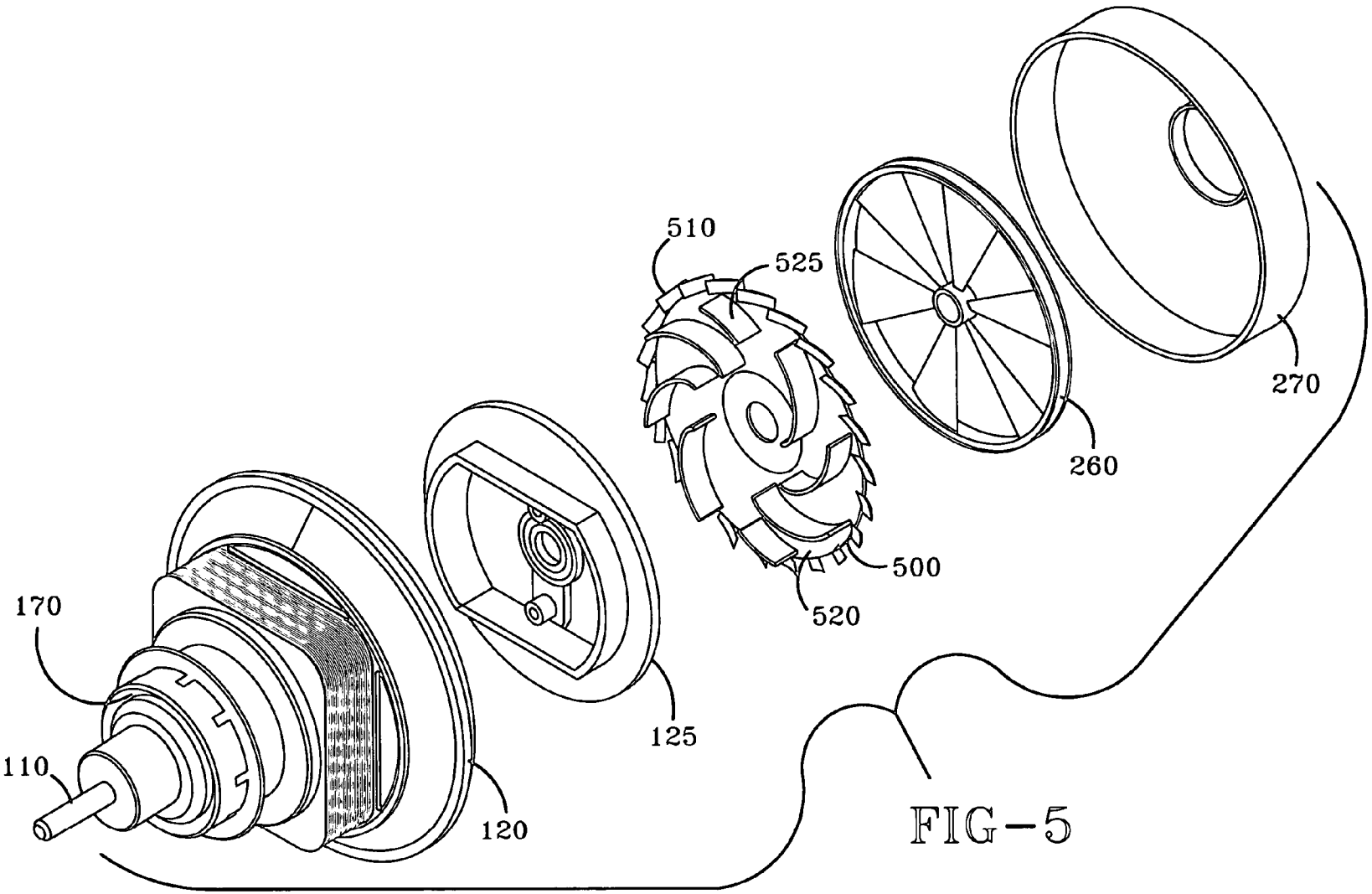
FIG. 5 is an exploded perspective view of a motor-fan assembly for a floor care appliance with a diffuser for improving efficiency and reducing noise, according to an alternate embodiment of the present invention.
Figure 6:
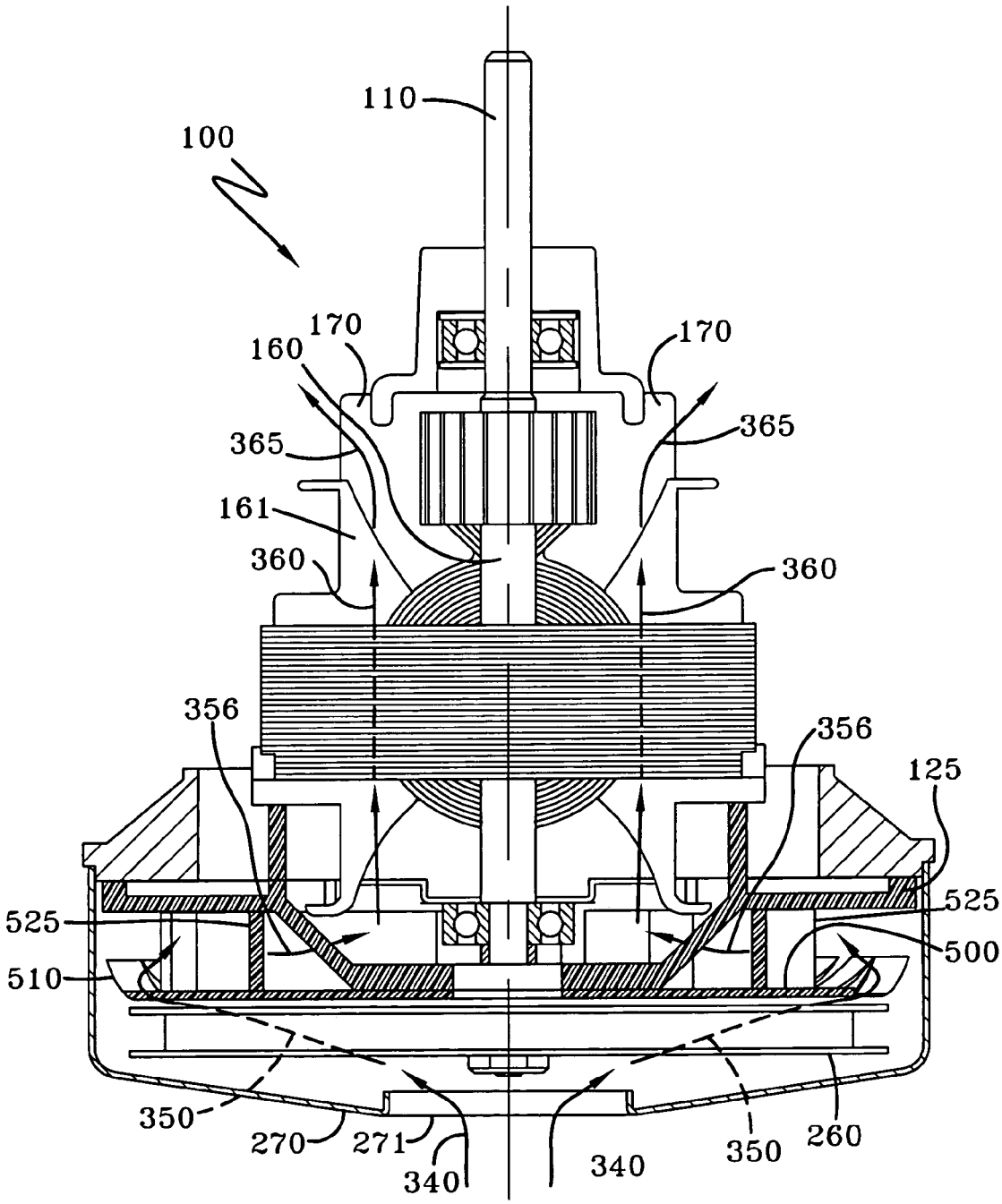
FIG. 6 is sectional view of the motor-fan assembly shown in FIG. 5, according to the alternate embodiment of the present invention.
Figure 7:
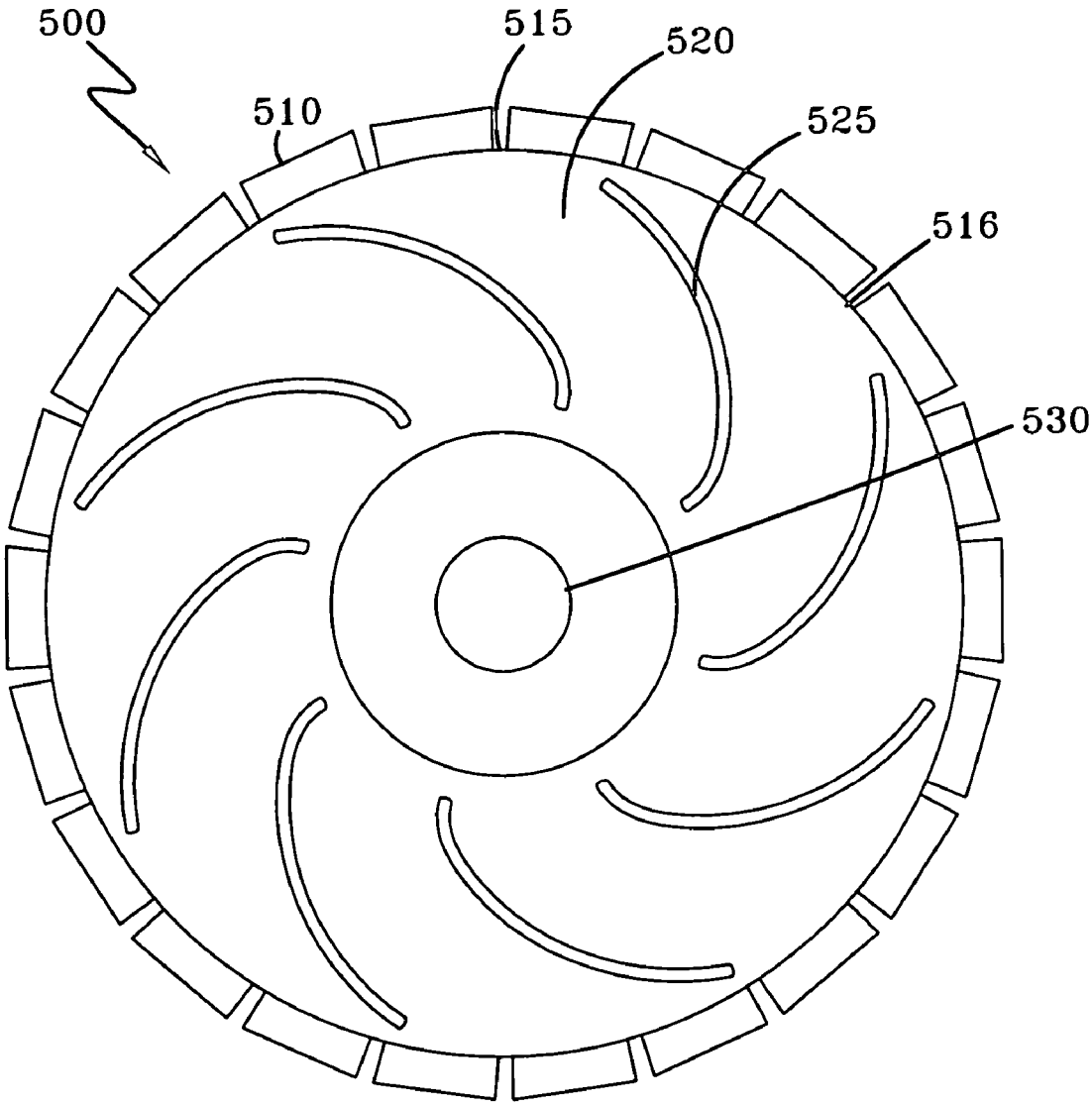
FIG. 7 is a bottom view of the diffuser for the motor-fan assembly of FIG. 5; according to the preferred embodiment of the present invention.

Referring now to FIGS. 5 to 7, shown is a motor-fan assembly 100 nearly identical to the one seen in the preferred embodiment shown in FIGS. 1 to 4, according to the alternate embodiment of the invention. Shown is a motor-fan assembly 100 with a diffuser 500. Coincident with the motor shaft 110 is the diffuser 500, a working air fan 260 and a housing cover 270. Air is drawn (arrows 340) into the suction inlet 271 located at the center of housing 270 by the working air fan 260 and passes through the impeller working air fan (arrows 350) being directed toward diffuser 500. Air is drawn into diffuser 500 and directed and slowed by vanes 510 on the periphery of diffuser 500 and directed (arrows 356) to the underside 520 of diffuser 500 through gaps 515 between successive vanes 510. Vanes 510 are similar in shape to an airfoil and taper downward. Like in the preferred embodiment, the airflow is slowed raising the static pressure and made more uniform to reduce airflow noise. The airflow is then directed by return vanes 525 (arrow 356) to the interior 161 and internal components 160 of the motor-fan assembly 100 for cooling before exiting to the atmosphere (arrows 365) through passages 170.

It should be clear from the foregoing that the described structure clearly meets the objects of the invention set out in the description's beginning. It should now also be obvious that many changes could be made to the disclosed structure which would still fall within its spirit and purview.

The invention claimed is:

1. A diffuser for a motor-fan assembly, comprising:

a disc-shaped plate having a lower surface;

plural apertures defined by an outer periphery of said plate, said apertures opening radially outward and adapted to direct airflow to a first plurality of vanes located on the outer periphery for directing airflow towards the lower surface of the plate; and a second plurality of vanes on the lower surface arranged circumferentially for slowing and directing the airflow to the interior of the motor-fan assembly.

2. The diffuser of claim 1, wherein said first plurality of vanes are comprised of an aperture on the periphery of the plate and a channel for directing the airflow towards the lower surface of the plate.

3. The diffuser of claim 1, wherein said first plurality of vanes are airfoil shaped and angled downward for directing the airflow towards the lower surface of the plate.

4. The diffuser of claim 1, wherein said second plurality of vanes are spiral shaped.

5. A motor-fan assembly having a diffuser of the type for slowing the airflow and reducing airflow noise, comprising:

a housing, armature, and related components;

a disc-shaped plate having a lower surface;

plural apertures defined by an outer periphery of said plate, said apertures opening radially outward and adapted to direct airflow to a first plurality of vanes located on the outer periphery for directing airflow towards the lower surface of the plate; and a second plurality of vanes on the lower surface arranged circumferentially for slowing and directing the airflow to the interior of the motor-fan assembly.

6. The motor-fan assembly of claim 5, wherein said first plurality of vanes are airfoil shaped and angled downward for directing the airflow towards the lower surface of the plate.

7. The motor-fan assembly of claim 5, wherein said second plurality of vanes are spiral shaped.

8. A floor care appliance, comprising:

a motor-fan assembly for creating an airflow;

a diffuser for slowing the airflow and reducing airflow noise, comprising:

a disc-shaped plate having a lower surface;

plural apertures defined by an outer periphery of said plate, said apertures opening radially outward and adapted to direct airflow to a first plurality of vanes located on the outer periphery for directing airflow towards the lower surface of the plate; and a second plurality of vanes on the lower surface arranged circumferentially for slowing and directing the airflow to the interior of the motor-fan assembly.

9. The floor care appliance of claim 8, wherein said first plurality of vanes are airfoil shaped and angled downward for directing the airflow towards the lower surface of the plate.

10. The floor care appliance of claim 5, wherein said second plurality of vanes are spiral shaped.

11. A diffuser for a motor-fan assembly, comprising:

a disc-shaped plate having a lower surface;

a first plurality of vanes extending radially outward from said plate to define an outer periphery of the diffuser, wherein said first plurality of vanes define radially outward opening apertures for directing airflow into said first plurality of vanes;

said first plurality of vanes being adapted to direct airflow toward the lower surface of said plate; and a second plurality of vanes extending downward from said lower surface of said plate and arranged circumferentially for slowing and directing airflow to the interior of the motor fan assembly.

* * * * *